US006592396B2

(12) United States Patent
Pepe et al.

(10) Patent No.: US 6,592,396 B2
(45) Date of Patent: Jul. 15, 2003

(54) CAP FOR AN ELECTRICAL CONNECTOR

(75) Inventors: Paul J. Pepe, Winston-Salem, NC (US); Brian K. Davis, Winston-Salem, NC (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 09/760,093

(22) Filed: Jan. 12, 2001

(65) Prior Publication Data

US 2002/0094715 A1 Jul. 18, 2002

(51) Int. Cl.[7] ..... H01R 4/24
(52) U.S. Cl. ..... 439/417
(58) Field of Search ..... 439/417, 395, 439/404, 406, 407, 443, 391, 453, 455, 445, 447, 446, 448, 460, 461, 462, 463, 464

(56) References Cited

U.S. PATENT DOCUMENTS 4,842,548 A * 6/1989 Bolante ..... 439/461
4,960,389 A * 10/1990 Frantz et al. ..... 439/404
5,305,547 A * 4/1994 Weiss ..... 439/395
5,354,212 A 10/1994 Bartle et al. ..... 439/468
5,366,018 A * 11/1994 Van Steenwyk et al. .... 166/385
5,385,484 A 1/1995 Bartle et al. ..... 439/468
5,387,123 A 2/1995 Puerner ..... 439/460
5,752,849 A 5/1998 Orlando ..... 439/412
5,762,520 A 6/1998 Martin ..... 439/470
5,885,111 A 3/1999 Yu ..... 439/676
5,899,770 A 5/1999 Ezawa ..... 439/418
5,975,936 A 11/1999 Lin et al. ..... 439/404
5,989,071 A 11/1999 Larsen et al. ..... 439/676
6,010,353 A 1/2000 Ensz et al. ..... 439/404
6,056,586 A 5/2000 Lin ..... 439/460
6,086,506 A * 5/2000 Shen ..... 439/447

* cited by examiner

*Primary Examiner*—Ross Gushi

(57) ABSTRACT

A cap for covering an electrical connector has a hollow tube with an exterior that is reversely tapered relative to the interior of the hollow tube, which adapts the tube for manufacture by a tapered mold core pin and a tapered molding die cavity, and which adapts the tube to funnel an electrical cable along the hollow tube.

12 Claims, 5 Drawing Sheets

CAP FOR AN ELECTRICAL CONNECTOR

BACKGROUND OF THE INVENTION

1. Field of the Invention

The invention relates to an electrical connector, and, more particularly, to a cap having a cover portion that is latchable to an electrical connector.

2. Related Art

U.S. Pat. No. 5,885,111 discloses a known cap for receiving an electrical cable therethrough, and for covering respective electrical wires that project out of the cable for termination with an electrical connector. The known insulating cap is fabricated in two pieces that must be assembled together to encircle the electrical cable. A disadvantage is, that the two pieces are unable to provide a tube that limits bending of the cable. Further, the two pieces can be lost prior to being assembled.

U.S. Pat. No. 5,899,770 discloses a known insulating cap for receiving an electrical cable therethrough. Although the cap appears to have a cable-receiving tube, the tube is without a tapered interior, and has an untapered exterior with circumferential indentations. Accordingly, the tube is unable to be adapted for molding in a molding operation.

SUMMARY OF THE INVENTION

The invention relates to a cap for an electrical connector, and, more particularly, to a cap having a cover portion that is latchable to an electrical connector. The cap has a cable-receiving, hollow tube adapted for molding in a molding operation.

An object of the invention is to provide a cap for an electrical connector, wherein a cover portion of the cap has a cable-receiving, hollow tube that is adapted for molding in a molding operation.

Another object of the invention is to provide a cover portion of a cap for an electrical connector, wherein the cover portion has a cable-receiving, hollow tube, and the hollow tube has a cable-receiving length greater than a its diameter, and greater than a thickness of the cover portion.

According to an embodiment of the invention, a cap for an electrical connector has a cable-receiving, hollow tube with a tapered interior extending axially from a larger opening at an outward end of the hollow tube to a smaller opening through the cover portion, such that the hollow tube has a tapered interior from which a tapered molding core pin is readily withdrawn in a rearward direction from the tapered interior after formation of the hollow tube by a straight draw molding operation.

According to another embodiment of the invention, a cap for an electrical connector has a cable-receiving, hollow tube with a tapered exterior, the exterior extending axially from a larger exterior circumference at the cover of the cap to a smaller exterior circumference at the outward end of the hollow tube, such that the exterior is readily withdrawn from a tapered molding die cavity after formation of the hollow tube by a molding operation.

According to another embodiment of the invention, a cap for an electrical connector has a cable-receiving, hollow tube, the hollow tube being internally tapered from a larger opening at an outward end to a smaller opening at an interior of the cover, and an exterior of the hollow tube being tapered from a larger circumference at the cover to a smaller circumference the outward end of the hollow tube, such that the exterior is reversely tapered relative to the interior of the hollow tube, whereby the hollow tube is readily withdrawn from between a tapered molding core pin and a reversely tapered molding die cavity after formation of the hollow tube by a molding operation.

According to another embodiment of the invention, a cap for an electrical connector has a cable-receiving, hollow tube, the hollow tube having an interior length greater than a thickness of the cover portion, and greater than its diameter, which limits bending of an electrical cable extending along the interior.

Other objects and advantages of the invention are disclosed by an embodiment of the invention. An embodiment of the invention will now be described by way of example, with reference to the accompanying drawings, according to which:

DETAILED DESCRIPTION

Figure 1:
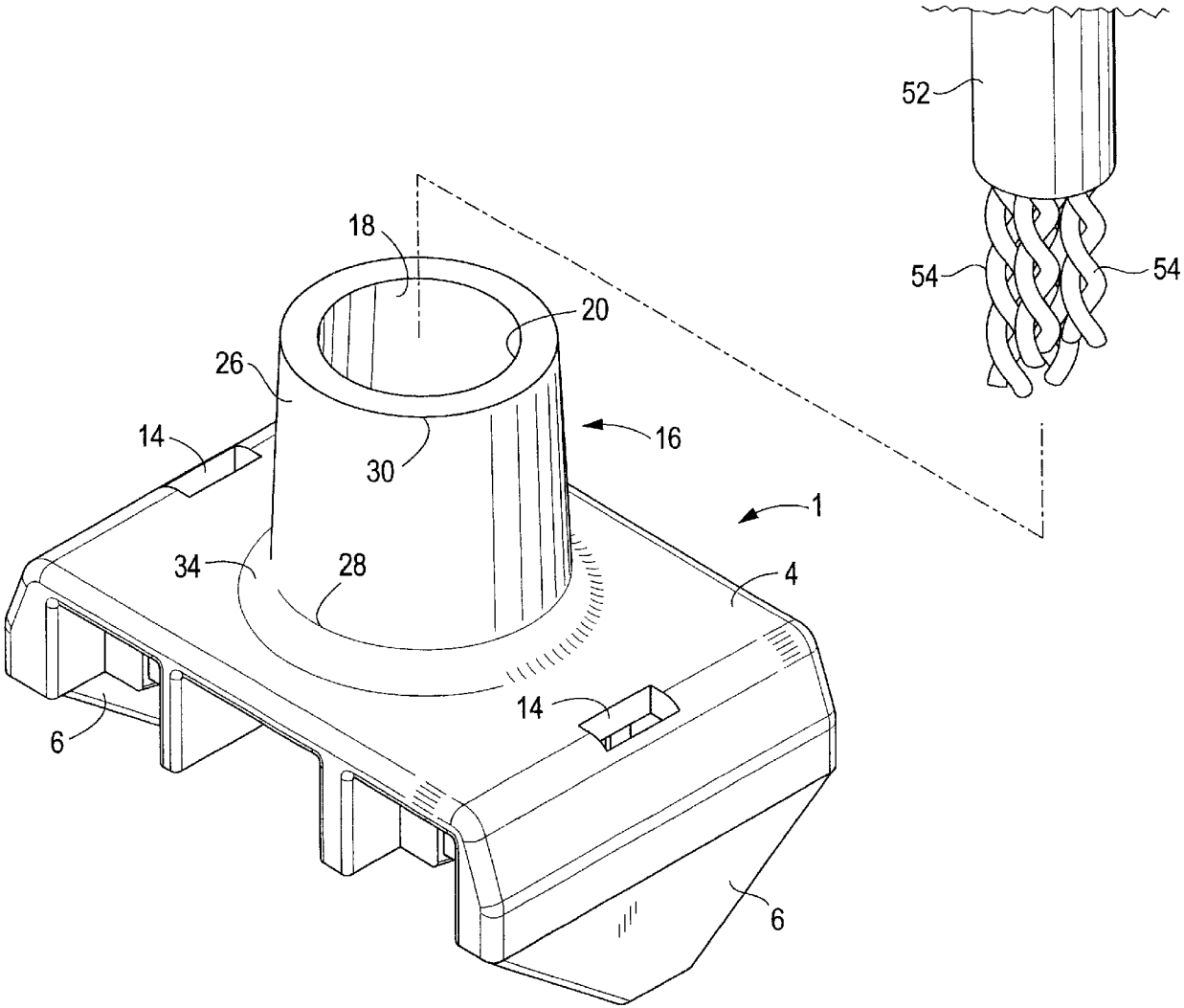
FIG. 1 is an isometric view of a cap for an electrical connector.
Figure 2:
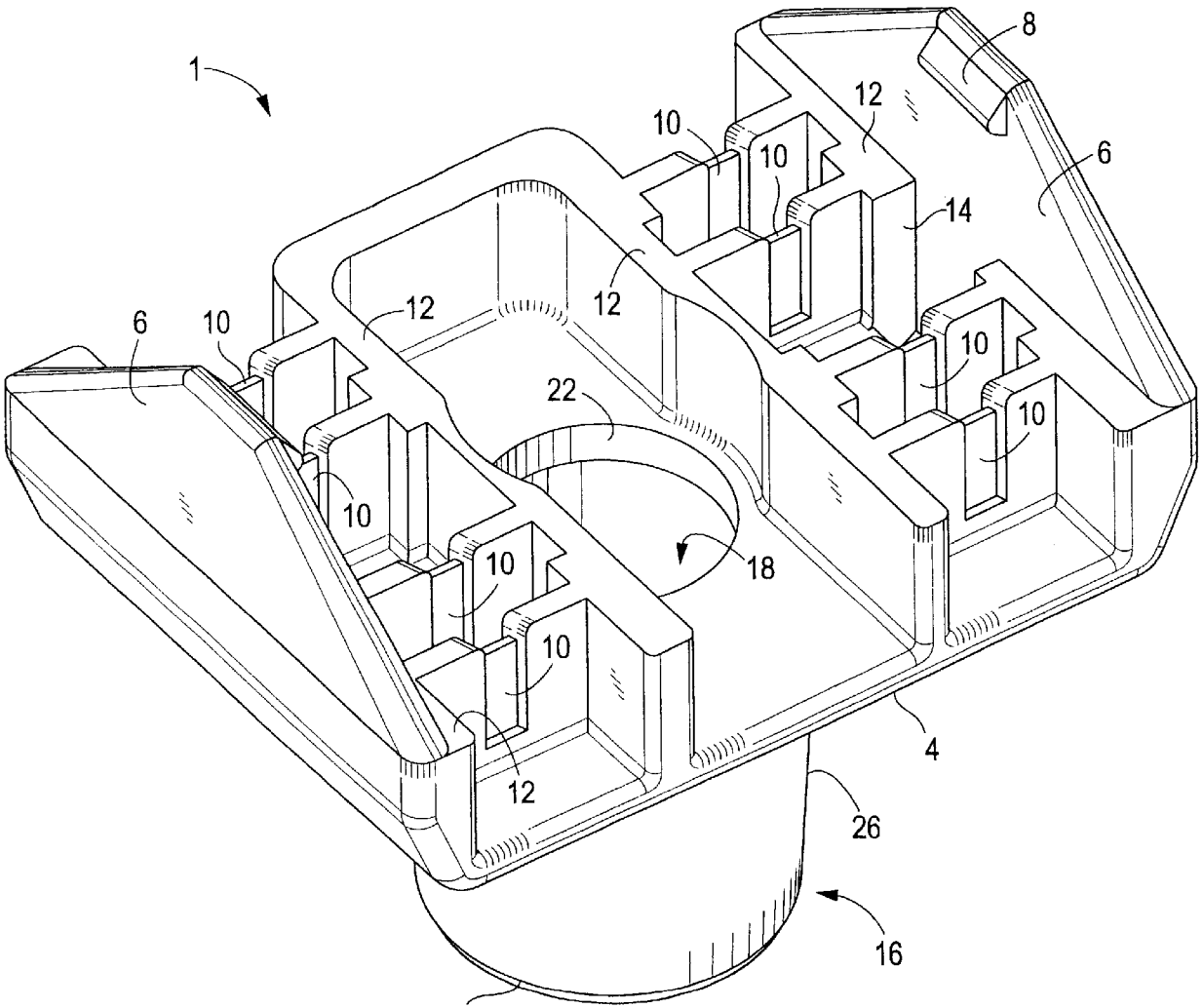
FIG. 2 is an isometric view of an interior of the cap disclosed by FIG. 1.
Figure 3:
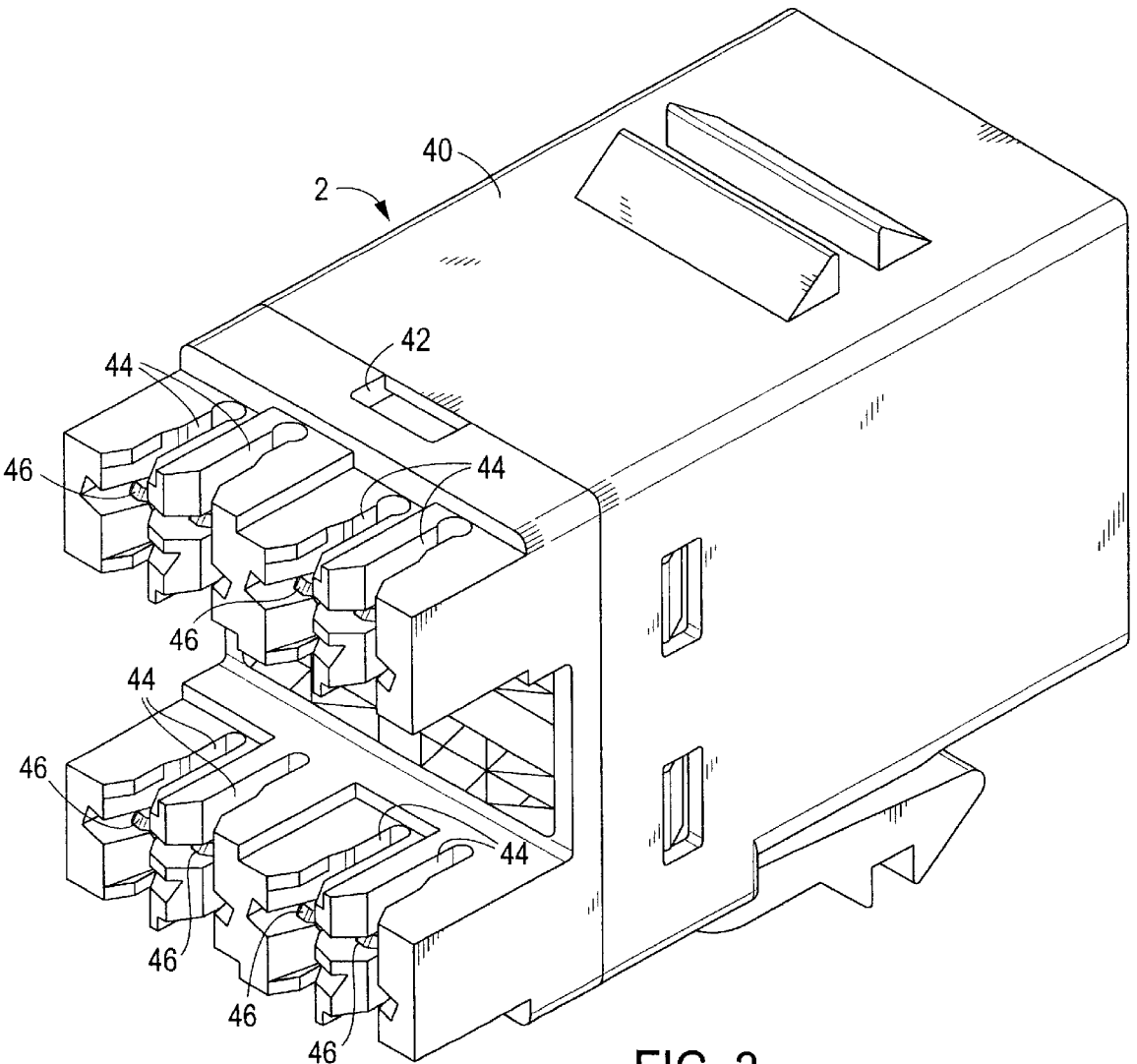
FIG. 3 is an isometric view of a rear of an electrical connector.

FIG. 1 discloses a single piece, insulating cap 1 for an electrical connector 2, FIG. 3. The cap 1 has a thin, rectangular cover portion 4 for covering a rear of the electrical connector 2. FIG. 2 discloses that the cover portion 4 has integral latching arms 6. A latching tab 8 is on an inward side of each of the latching arms 6.

FIG. 2 further discloses multiple, spaced apart, wire stuffer flanges 10 on an interior of the cover portion 4. Each of the flanges 10 bridges between spaced apart walls 12 on the interior of the cover portion 4. The flanges 10 and the walls 12 project in a direction that is axially in a forward direction. Each of the latching tabs 8 is aligned with a passage 14 through a respective one of the walls 12. FIG. 1 discloses that each passage 14 extends through the cover portion 4.

FIG. 1 further discloses that the cover portion 4 has a cable-receiving, hollow tube 16 that extends axially in a rear direction. The hollow tube 16 has a cable-receiving, tapered interior 18 extending axially from a larger opening 20 at an outward end of the hollow tube 16 to a smaller opening 22 through the cover portion 4, such that the hollow tube 16 has a tapered interior 18.

Figure 5:
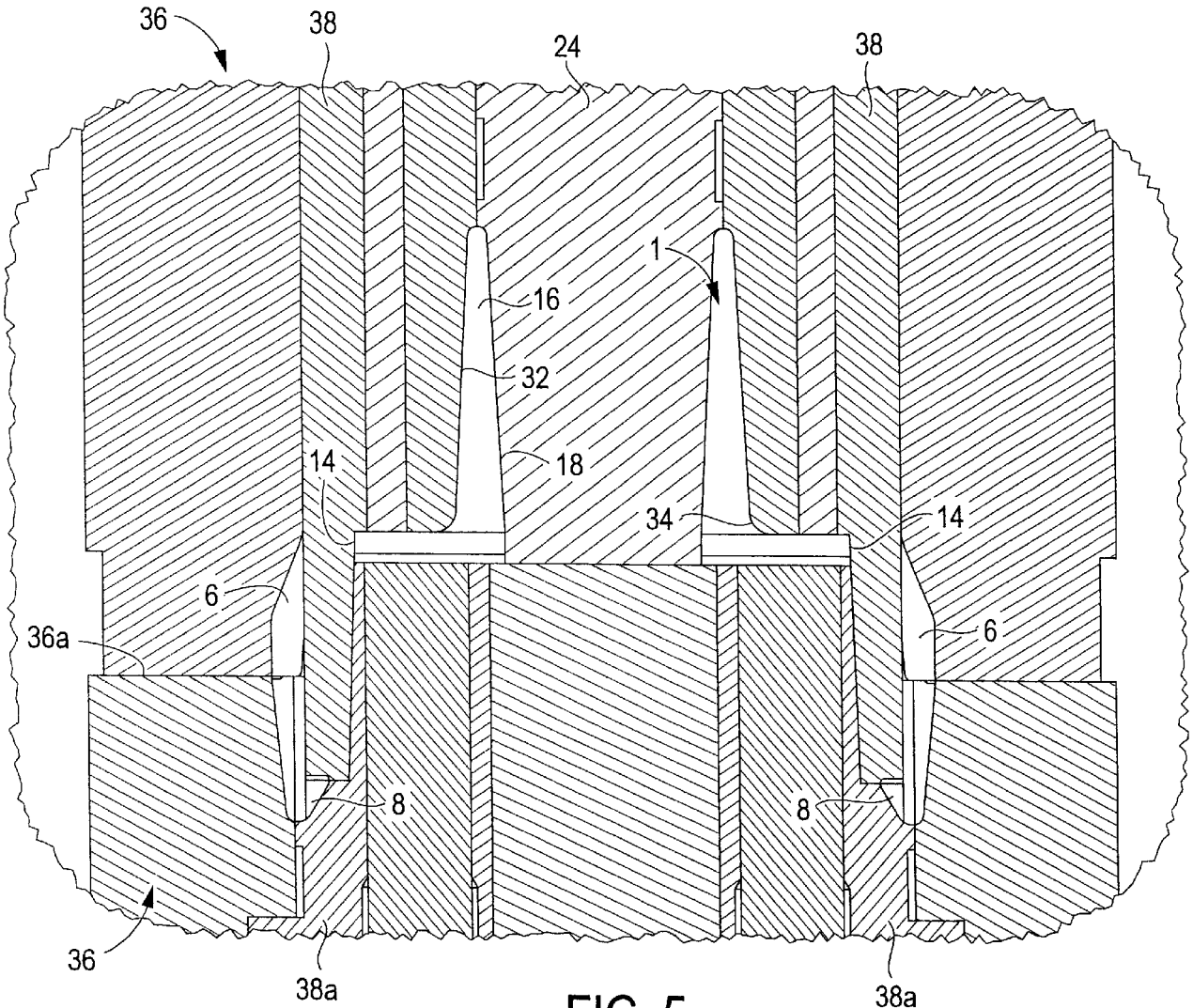
FIG. 5 is a cross section of the cap disclosed by FIG. 1, together with portions of a molding die and a molding core pin.

As disclosed by FIG. 5, the hollow tube 16 has a tapered interior 18 from which a tapered molding core pin 24 is readily withdrawn in a rearward direction from the tapered interior 18 after formation of the hollow tube 16 by a molding operation.

FIGS. 1 and 2 further disclose the hollow tube 16 having an exterior 26 that is reversely tapered relative to the interior 18 of the hollow tube 16, the exterior 26 extending axially from a larger exterior circumference 28 at the cover portion 4 of the cap 2 to a smaller exterior circumference 30 at the outward end of the hollow tube 16, such that the exterior 26 is readily withdrawn from a tapered molding die cavity 32, FIG. 5, after formation of the hollow tube 16 by a molding operation. A fillet 34 of insulating material is formed on an inside corner at an intersection of the hollow tube 16 and the cover portion 4.

FIG. 5 further discloses a pair of molding dies 36 that meet along a mold parting line 36*a*, and that define therebetween the molding die cavity 32. The upper one of the dies 36 slidably receives therein the tapered molding core pin 24. The cap 1 is fabricated by molding a fluent insulating material that is injected into the cavity 32, and is shaped by the molding die cavity 32 and the molding core pin 24. After formation of the cap 1 by solidification of the insulating material, the tapered core pin 24 is readily withdrawn, slidably from the upper molding die 36. The pair of dies 36 separate from each other along the parting line 36*a*, and the cap 1, that has been fabricated by molding in the tapered die cavity 32, is readily withdrawn from the tapered die cavity 32.

Additional molding core pins 38 extend slidably in the upper molding die 36, and engage opposing further core pins 38*a* that are slidable in the lower molding die 36. The core pins 38 and 38*a* extend in the tapered die cavity 32 to form the latching tabs 8 that are aligned with the passages 14. The passages 14 are provided to allow withdrawal of the molding core pins 38 from the fabricated cap 1, after formation of the latching tabs 8 in the tapered die cavity 32.

Figure 4:
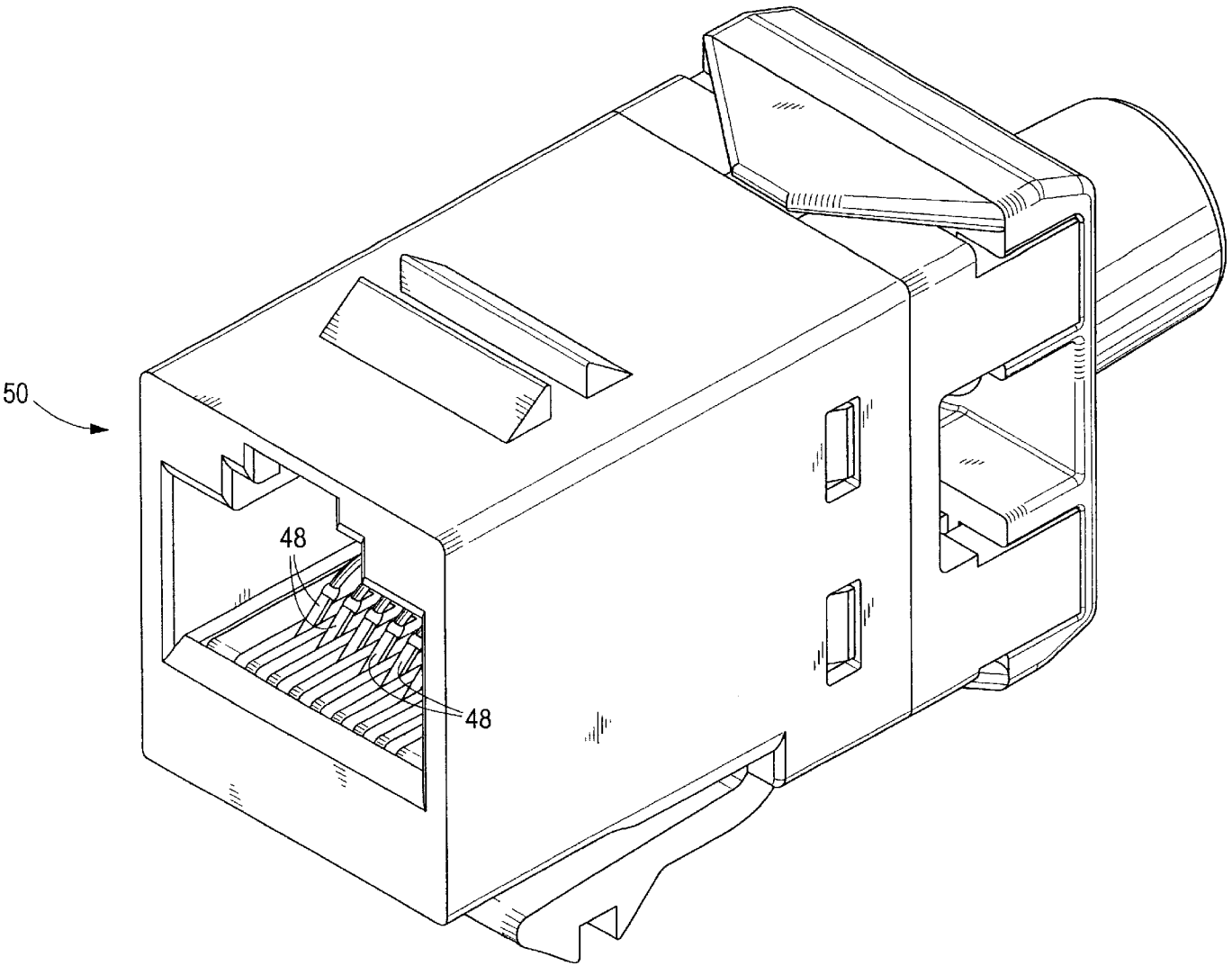
FIG. 4 is an isometric view of the cap disclosed by FIG. 1 assembled to the electrical connector disclosed by FIG. 3.

FIG. 3 discloses the electrical connector 2 having an insulating housing 40. The housing 40 has latching recesses 42. A rear of the housing 40 has multiple, wire receiving slots 44 that are adapted to receive respective wire stuffer flanges 10. Known insulation displacement contacts, IDC, electrical contacts 46 extend across the wire receiving slots 44. FIG. 4 further discloses known electrical contacts 48 of a modular jack 50 to which the IDC contacts 46 are connected. For example, U.S. Pat. No. 5,885,111 discloses IDC contacts that are connected integrally to known electrical contacts of a modular jack.

FIG. 1 further discloses an electrical cable 52 containing multiple, insulated wires 54. For example, the insulated wires 54 are arranged in twisted pairs. The end of the cable 52 is inserted into the hollow tube 16. The hollow tube 16 provides an open flared funnel at the larger opening 20 through which the electrical cable 52 is readily inserted and funneled for receipt of the electrical cable 52 along the hollow tube 16. The cap 1 is slidable along the cable 52. The hollow tube 16 has an interior length greater than its diameter, and greater than a thickness of the cover portion 4, which limits bending of the cable 52 that is adapted to extend along the interior 18 of the hollow tube 16.

According to an embodiment, the cable 52 is an FTP or UTP cable with shielded or unshielded wires of 22 gauge, 23 gauge or 24 gauge solid wires, or of 24 gauge stranded wires. Such a cable is specified by a TIA/EIA industry standard specification. The smaller opening 22 of the hollow tube 16 is sized to fit snugly and slidably around the cable 52 of the largest size, as specified by the industry standard specification.

The respective wire receiving slots 44 disclosed by FIG. 3 are adapted to receive respective insulated wires 54 that extend from the end of the cable 52. The insulated wires 54 are laced by an operator along respective, wire receiving slots 44. The cap 1 is slidable along the cable 52, and is adapted to be assembled to the electrical connector 2, to cover the rear of the electrical connector 2, as disclosed by FIG. 5. The wire stuffer flanges 10 are adapted to be received along the wire receiving slots 44 to engage the wires 54 along the slots 44, and urge the wires 54 into connection with the IDC electrical contacts 46. The wires 54 become electrically connected to the IDC contacts 46, and are terminated by the electrical connector 4. The latching tabs 8 are adapted to be received in the latching recesses 42, thus, latching and holding the cover portion 4 of the cap 1 in place.

An embodiment of the invention having been described, other embodiments and modifications of the invention are intended to be covered by the spirit and scope of the appended claims.

What is claimed is:

1. An insulating cap for receiving an electrical cable therethrough, and for covering respective electrical wires of the cable that are terminated with an electrical connector, comprising:

a cover portion of the cap being latchable to a housing of the electrical connector, wire stuffer flanges on an interior of the rear cover being engageable with the respective wires, the flanges projecting axially in a forward direction, and a cable-receiving hollow tube extending axially in a rear direction, and the hollow tube having a cable-receiving, interior extending axially from a larger opening at an outward end of the hollow tube to a smaller opening through the cover portion, said interior being tapered along the entire length from the outward end of the tube to the cover portion, such that the hollow tube has a tapered interior from which a tapered molding core pin is readily withdrawn in a rearward direction from the tapered interior after formation of the hollow tube by a molding operation.

2. An insulating cap as recited in claim 1, and further comprising: the hollow tube providing a funnel at the larger opening through which an electrical cable is readily inserted for receipt of the electrical cable along the hollow tube.

3. An insulating cap as recited in claim 1, and further comprising: the smaller opening being sized to fit snugly around an electrical cable received along the interior of the hollow tube.

4. An insulating cap as recited in claim 1, and further comprising: the hollow tube having an interior length greater than a thickness of the cover portion, and greater than its diameter, which limits bending of an electrical cable extending along the interior.

5. An insulating cap as recited in claim 1, and further comprising: the hollow tube having an exterior that is reversely tapered relative to the interior of the hollow tube, the exterior extending axially from a larger exterior circumference at the cover of the cap to a smaller exterior circumference at the outward end of the hollow tube, said exterior being tapered along the entire length between the outward end and the cover, such that the exterior is readily withdrawn from a tapered molding die cavity after formation of the hollow tube by a molding operation.

6. An insulating cap comprising: a cover portion of the cap being latchable to a remainder of an electrical connector, and a cable-receiving hollow tube being internally tapered along its entire length from a larger opening at an outward end to a smaller opening at an interior of the cover, and an exterior of the hollow tube being tapered along its entire length from a larger circumference at the cover to a smaller circumference the outward end of the hollow tube, such that the exterior is reversely tapered relative to the interior of the hollow tube, whereby the hollow tube is readily withdrawn from between a tapered molding core pin and a reversely tapered molding die cavity after formation of the hollow tube by a molding operation.

7. An insulating cap as recited in claim 6, and further comprising: the hollow tube providing a funnel at the larger opening through which an electrical cable is readily inserted for receipt of the electrical cable along the hollow tube.

8. An insulating cap as recited in claim 6, and further comprising: the smaller opening being sized to fit snugly around an electrical cable received along the interior of the hollow tube.

9. An insulating cap as recited in claim 6, and further comprising: the hollow tube having an interior length greater than a thickness of the cover portion, and greater than its diameter, which limits bending of an electrical cable extending along the interior.

10. An insulating cap for receiving an electrical cable therethrough, and for covering respective electrical wires of the cable that are terminated with an electrical connector, comprising:

a cover portion of the cap being latchable to a housing of the electrical connector, wire stuffer flanges on an interior of the rear cover being engageable with the respective wires, the flanges projecting axially in a forward direction, and a cable-receiving hollow tube extending axially in a rear direction, and the hollow tube having an exterior extending axially from a larger exterior circumference at the cover of the cap to a smaller exterior circumference at the outward end of the hollow tube, said exterior being tapered along the entire length between the outward end and the cover such that the exterior is readily withdrawn from a tapered molding die cavity after formation of the hollow tube by a molding operation.

11. An insulating cap as recited in claim 10, and further comprising: the hollow tube having an interior length greater than a thickness of the cover portion, and greater than its diameter, which limits bending of an electrical cable extending along the interior.

12. An insulating cap as recited in claim 10, and further comprising: the hollow tube having an exterior that is reversely tapered relative to the interior of the hollow tube.

* * * * *